United States Patent [19]

Schreiber et al.

[11] Patent Number: 4,818,446

[45] Date of Patent: Apr. 4, 1989

[54] APPARATUS FOR INTRODUCING A GAS INTO A FLUID

[75] Inventors: Berthold Schreiber; Erhard Schreiber, both of Hanover, Fed. Rep. of Germany

[73] Assignee: Schreiber Corporation, Inc., Trussville, Ala.

[21] Appl. No.: 113,972

[22] Filed: Oct. 29, 1987

[30] Foreign Application Priority Data

Oct. 30, 1986 [DE] Fed. Rep. of Germany ..... 3636882

[51] Int. Cl.[4] ..... B01F 3/04

[52] U.S. Cl. ..... 261/122

[58] Field of Search ..... 261/122

[56] References Cited

U.S. PATENT DOCUMENTS

| | | | |
|---|---|---|---|
| 2,815,943 | 12/1957 | Lamb | 261/122 |
| 3,837,629 | 9/1974 | Matras et al. | 261/122 |
| 3,915,862 | 10/1975 | Moloney | 261/122 |
| 3,953,553 | 4/1976 | Thayer | 261/122 |
| 4,007,240 | 2/1977 | Gosden | 261/122 |
| 4,060,486 | 11/1977 | Schreiber | 261/122 |
| 4,165,286 | 8/1979 | Schreiber et al. | 261/122 |
| 4,192,255 | 3/1980 | Willinger | 261/122 |
| 4,428,893 | 1/1984 | Cummings, Jr. et al. | 261/122 |
| 4,489,016 | 12/1984 | Kriebel | 261/122 |

FOREIGN PATENT DOCUMENTS

| | | | |
|---|---|---|---|
| 2554738 | 6/1976 | Fed. Rep. of Germany . | |
| 7816785 | 9/1978 | Fed. Rep. of Germany . | |
| 8129307 | 7/1983 | Fed. Rep. of Germany . | |
| 8321550 | 11/1983 | Fed. Rep. of Germany . | |
| 3418548 | 11/1985 | Fed. Rep. of Germany | 261/122 |
| 3319161 | 9/1987 | Fed. Rep. of Germany . | |
| 348125 | 9/1960 | Switzerland | 261/122 |

*Primary Examiner*—Tim Miles

*Attorney, Agent, or Firm*—Bell, Seltzer, Park, and Gibson

[57] ABSTRACT

An apparatus for introducing gases in the form of fine bubbles into a fluid is described, in which a diffuser pipe for a perforated distributor hose is mounted on a gas supply pipe. The diffuser pipe is constructed in one piece, extends transversely across the gas supply pipe, and is attached to the same by means of clamping elements. An opening for the passage of the gas is provided between the diffuser pipe and gas supply pipe. A pair of plugs positioned in the diffuser pipe define a flooding chamber at each end of the pipe and a gas-carrying chamber positioned medially therebetween. The apparatus is particularly suitable for the aeration of activation tanks for waste water.

20 Claims, 1 Drawing Sheet

APPARATUS FOR INTRODUCING A GAS INTO A FLUID

FIELD OF THE INVENTION

The invention relates to an apparatus for introducing a gas in the form of fine bubbles into a fluid, and particularly relates to an apparatus for the aeration of waste water in the activation tanks of clarification plants and the like.

BACKGROUND OF THE INVENTION

Waste water treatement processes typically include a step in which gas is contacted to the waste water being treated. It is known to use unilaterally open diffuser pipes for elastomeric diffuser sleeves which are perforated for air to pass through to introduce air in the form of fine bubbles into waste water. See, e.g., U.S. Pat. No. 4,165,286 to Schreiber. In a typical device of this type, the diffuser sleeves are mounted on the diffuser pipes by means of hose clips. The diffuser pipes are closed by a solid wall on their sides opposite to the open ends. A threaded nut or sleeve is inserted inside the wall, into which a tie rod can be screwed via a bore. A tie rod connects two coaxially arranged carrier pipes with the air pipe at a right angle, with the tie rod extending through the air supply pipe. Such an arrangement is disclosed, for example, in DE-OS 34 18 548. See also U.S. Pat. No. 4,060,486 to Schreiber.

While in the above-described design the tie rod only extends into the solid breechlock mechanism parts of the diffuser pipes, it is common practice in other known aeration systems to extend the tie rod through the entire length of the nonfloodable diffuser pipes. The ends of the tie rod are provided with a thread and extend through the closing walls on the front side of the outer ends of the diffuser pipe. With the aid of nuts and sealing rings the diffuser pipes are pressed, impermeably to gas, with their inner open ends against a gas supply pipe.

Both of these designs, particularly the design shown in DE-OS 34 18 548, have a common disadvantage: they are costly to manufacture. Moreover, the mounting of two nonfloodable diffuser pipes with the assistance of a continuous tie rod it not a construction suitable for assembly and disassembly by one person because of the large dimensions and the numerous component parts involved. Of late, diffuser pipes have been constructed of plastic, but the buoyancy of such pipes requires special modifications to the apparatus to maintain the apparatus submerged. Accordingly, objects of the present invention are to provide an aerating apparatus which is low in buoyancy and can be assembled by one person from simple, commerically available and inexpensive parts.

SUMMARY OF THE INVENTION

The present invention, in one respect, comprises a gas supply pipe and an elongate gas diffuser pipe. The diffuser pipe defines a medial portion and opposite end portions, and has plug means disposed in each of the end portions so as to define a closed gas chamber between the plug means and an open ended flooding chamber in each of the opposite end portions. At least one gas distribution opening extends through each of the opposite end portions within the closed gas chamber. Means are provided for mounting the medial portion of the gas diffuser pipe to the gas supply pipe to provide gas communication between the gas supply pipe and the closed gas chamber of the gas diffuser pipe.

An elastomeric diffuser sleeve is disposed coaxially over each of the end portions of the diffuser pipe so as to overlie the associated gas distribution opening. Each of the sleeves has a multiplicity of perforations therein. In use, gas from the supply pipe enters into the closed gas chamber and passes through the distribution openings and the minute perforations of the diffuser sleeve to form fine bubbles in the liquid being treated. At the same time, the liquid being treated enters the open ended flooding chambers to reduce the buoyancy of the apparatus.

The present invention, in another respect, comprises a gas supply pipe having a gas outlet opening extending therethrough, and an elongate gas diffuser pipe. The diffuser pipe defines a medial portion and opposite end portions, and has a gas inlet opening extending through the medial portion and at least one distribution opening extending through each of the opposite end portions.

Means releasably mount the medial portion of the gas diffuser pipe to and transversely across the gas supply pipe, and align the outlet opening in the gas supply pipe with the inlet opening in the gas diffuser pipe. These aligned openings provide gas communication from the gas supply pipe to the medial portion of the gas diffuser pipe.

An elastomeric diffuser sleeve is disposed coaxially over each of the opposite end portions of the diffuser pipe. Each of the sleeves has a multiplicity of perforations therein. In operation, gas from the gas supply pipe enters into the gas diffuser pipe through the aligned openings, passes through the distribution openings and the minute perforations of the diffuser sleeve, and forms fine bubbles in the liquid being treated.

Another aspect of the present invention is a diffuser assembly which is a subcombination of the foregoing. This diffuser assembly comprises an elongate gas diffuser pipe defining a medial portion and opposite end portions. The diffuser pipe has plug means disposed in each of the end portions so as to define a closed gas chamber between the plug means and an open ended flooding chamber in each of the opposite end portions. At least one gas distribution opening extends through each of the opposite end portions within the closed gas chamber. A gas inlet opening extends through the medial portion of the diffuser pipe.

An elastomeric diffuser sleeve is disposed coaxially over each of the opposite end portions of the diffuser pipe. Each of the sleeves has a multiplicity of perforations therein. In use, gas enters the diffuser pipe medial portion through the gas inlet opening, passes through the distribution openings and the minute perforations in the diffuser sleeve, and forms fine bubbles in the liquid being treated. At the same time, liquid being treated enters the open ended flooding chambers to reduce the buoyancy of the apparatus.

BRIEF DESCRIPTION OF THE DRAWINGS

The foregoing and other objects and advantages of the present invention will be made apparent from the following detailed description and the drawings, in which.

DETAILED DESCRIPTION OF THE PREFERRED EMBODIMENT

Figure 3:
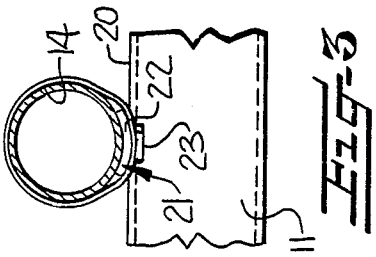
FIG. 3 is a sectional view of the diffuser pipe shown in FIG. 1 taken along the lines 3—3 of FIG. 1.
Figure 1:
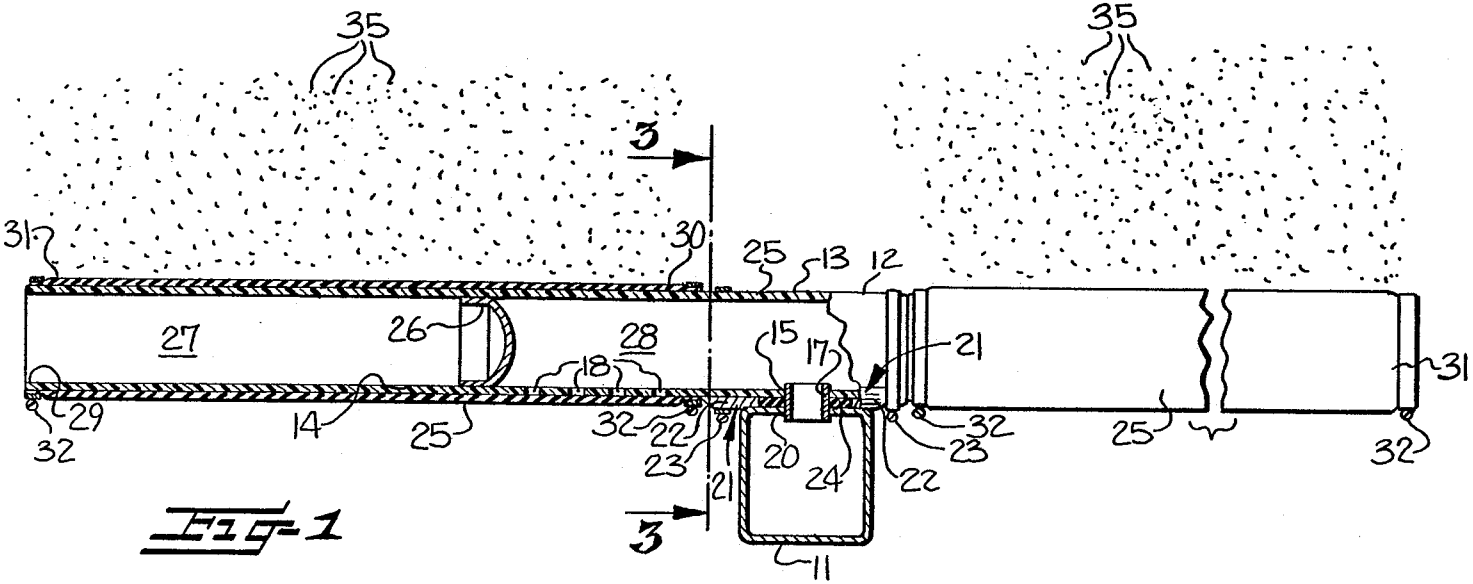
FIG. 1 is a side elevation view of a diffuser pipe mounted on a gas supply pipe.
Figure 2:
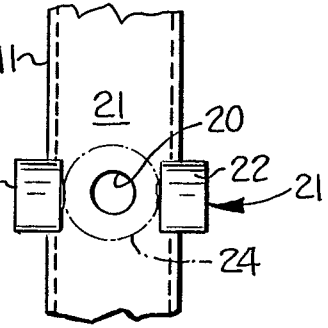
FIG. 2 is a top plan view of the gas supply pipe shown in FIG. 1 showing in detail the area where the diffuser pipe is mounted.

As illustrated in FIGS. 1 through 3, an apparatus of the present invention comprises a horizontally extending gas supply pipe 11 and an elongate unitary gas diffuser pipe 12. The diffuser pipe 12 has a medial portion 13 detachably connected to the gas supply pipe 11 and has opposite end portions 14 extending perpendicularly ouwardly from each side of the supply pipe 11. The diffuser pipe medial portion has a gas inlet opening 15 formed therein on the bottom side wall 16 thereof. The inlet opening 15 has a centering pipe 17 disposed therein and extending outward therefrom. In addition, the diffuser pipe end portions 14 each have a plurality of gas distribution openings 18 formed therein along the bottom side wall 16 thereof.

The supply pipe 11 has a gas exit opening 20 formed therein on the top side wall 21 thereof. Prior to assembly, the centering pipe 17 may optionally be disposed in the gas exit opening 20 instead of the gas inlet opening 15. The supply pipe has a support means 21 configured to receive the diffuser pipe positioned on each side of the exit opening. The supports 22 may be formed from flat steel bent into shape and welded to the supply pipe 11. A pipe clamp 23, as best shown in FIGS. 1 and 3, is carried by each of the concave supports 22, and is connected to the diffuser pipe medial portion 13 for securing the diffuser pipe 12 to the supply pipe 11 with the centering pipe 17 disposed in the gas exit opening 20. As shown in FIG. 1, a seal means comprising a rubber gasket 24 (shown in phantom in FIG. 2) surrounds the centering pipe 17 to prevent the escape of gas about this union.

An elastomeric diffuser sleeve 25 is disposed coaxially on each of the diffuser pipe end portions 14. Each of the sleeves has a multiplicity of perforations formed therein. Preferably, the perforations are uniformly distributed along the entire length of the sleeve.

A plug means 26 is disposed within each of the diffuser pipe end portions 14 for defining an open flooding chamber 27 in each side portion 14 of the diffuser pipe and a closed gas chamber 28 positioned between the plug means. The flooding chambers 27 are open to the exterior of the diffuser pipe side portions through the open outer ends 29 thereof, and are thereby filled by fluids in which the apparatus is immersed.

The open flooding chambers 27 and the closed gas chamber 28 are configured so that the buoyancy of the apparatus is reduced in liquids in which the apparatus is immersed. As a result of this feature, no special apparatus or modifications are required to keep the apparatus submerged in the liquid being treated. In addition, the added weight from the flooding chambers 27 reduces vibrations which arise when the apparatus is mounted for movement through a liquid being treated.

Each of the diffuser sleeves 14 has a medial sleeve end portion 30 positioned adjacent the diffuser pipe medial portion 13, and an outer sleeve end portion 31 positioned adjacent the diffuser pipe outer end 29. Thus, each diffuser sleeve 25 overlies substantially the entire length of each diffuser pipe side portion 14. The medial sleeve end portions 30 and the outer sleeve end portions 31 are provided with means connected to the same for sealing the same to the diffuser pipe side portion, which means in the illustrated embodiment comprise pipe clamps 32. Each plug means 26 is positioned medially of the outer sleeve end portion 31, and the gas distribution openings 18 are positioned medially of each of the plug means 26. Advantageously, as explained below, minute bubbles are produced along the entire length of the diffuser sleeve 24, while the interior of the diffuser pipe underlying the outer portion of each sleeve is filled by the fluid in which the apparatus is immersed.

The diffuser pipe 12 is preferably constructed of plastic. Preferably, the two diffuser pipe end portions 14 are of substantially equal length, and each individual plug means 26 is spaced inward from the outer end 29 of each diffuser pipe end portion 14 substantially the same distance as is the plug means in the opposite diffuser pipe end portion. Each of the plug means 26 preferably comprises a cup-shaped plastic insert having a convex, resilient inner surface 33 facing the medial gas chamber 28, which insert is sealably connected to the interior wall of the diffuser pipe 12.

In use, submerged in a fluid, gas circulates from the supply pipe 11 through the centering pipe 17 into the closed gas chamber 28. The gas then passes through the distribution openings 18 and travels between each diffuser sleeve 25 and each diffuser pipe end portion 14 substantially the entire length of each diffuser sleeve 25. The gas then passes through the perforations in the diffuser sleeve and forms fine bubbles 35 in the fluid being treated.

Equipment constructed according to the present invention permits assembly and disassembly to be performed by one person at the location of use. When joining the diffuser pipe with the gas supply pipe only one connecting place exists which needs to be sealed. As a result of the absence of a tie rod, different coefficients of expansion at temperature fluctuations need no longer be considered, so that any problems with the mounting and sealing caused thereby do not arise. The absent tie rod leads to a substantial reduction in weight. It should be noted that in waste water aeration units a plurality of diffuser pipes are mounted parallel to each other in a predetermined pattern on a gas supply pipe. In the case of aeration units commonly used and each comprising 40 to 48 diffuser pipes, a saving in weight of up to 138 pounds (63 kg) is obtained, which is a considerable advantage if assembly and maintenance work is to be performed by one person.

The present invention has been described in detail above. While specific terms are employed, they are used in a generic, descriptive sense only and are not to be taken as limiting, as the scope of the invention is defined by the following claims. Equivalents of the claims are to be included therein.

That which is claimed is:

1. An apparatus for introducing gas in the form of fine bubbles into a liquid and which is useful for the aeration of waste water or the like, and comprising a gas supply pipe, an elongate integral one-piece gas diffuser pipe having a medial portion, and opposite end portions integral with said medial portion, and having plug means disposed in each of said end portions so as to define a closed gas chamber between said plug means and an open ended flooding chamber in each of said opposite end portions, and at least one gas distribution opening extending through each of said opposite end portions and within said closed gas chamber.

means mounting said medial portion of said gas diffuser pipe to said gas supply pipe so as to provide gas communication between said gas supply pipe and said closed gas chamber of said gas diffuser pipe, and an elastomeric diffuser sleeve disposed coaxially over each of said end portions of said diffuser pipe and so as to overlie the associated gas distribution opening, with each of said sleeves having a multiplicity of perforations therein, whereby gas from said gas supply pipe is adapted to enter into said closed gas chamber and then pass through said distribution openings and said perforations of said diffuser sleeves to form fine bubbles in the liquid being treated, and so that the liquid being treated enters said open ended flooding chambers to reduce the buoyancy of the apparatus.

2. An apparatus as claimed in claim 1, wherein each of said diffuser pipe end portions terminates at an outer open end, wherein each of said diffuser sleeves has a medial sleeve end positioned adjacent said diffuser pipe medial portion and an outer sleeve end positioned adjacent said diffuser pipe outer end, and wherein each of said plug means is positioned medially of said outer sleeve end.

3. An apparatus as claimed in claim 2, wherein said minute perforations in said diffuser sleeve are substantially uniformly distributed along the length of said diffuser sleeve.

4. An apparatus for introducing gas in the form of fine bubbles into a liquid and which is useful for the aeration of waste water or the like, and comprising a gas supply pipe having a gas outlet opening extending therethrough, an elongate intergral one-piece gas diffuser pipe having a medial portion and opposite end portions integral with said medial portion, and having a gas inlet opening extending through said medial portion and at least one distribution opening extending through each of said opposite end portions, means releasably mounting said medial portion of said gas diffuser pipe to and transversely across said gas supply pipe and aligning said outlet opening in said gas supply pipe with said inlet opening in said gas diffuser pipe for providing gas communication from said gas supply pipe to said medial portion of said gas diffuser pipe, and an elastomeric diffuser sleeve disposed coaxially over each of said opposite end portions of said diffuser pipe, with each of said sleeves having a multiplivity of perforations therein, whereby the gas from said gas supply pipe is caused to enter into said medial portion of said gas diffuser pipe and then pass through said distribution openings and said perforations of said diffuser sleeves to form fine bubbles in the liquid being treated.

5. An apparatus as claimed in claim 4, further comprising a centering pipe positioned in said gas inlet opening and extending into said gas outlet opening, and seal means surrounding said centering pipe and positioned between said gas supply pipe and said gas diffuser pipe for preventing the escape of gas therefrom.

6. An apparatus as defined in claim 4, wherein said gas supply pipe comprises a horizontally extending gas supply pipe having an upper side wall and having said gas outlet opening positioned in said upper side wall, wherein said diffuser pipe comprises a horizontally extending diffuser pipe having a lower side wall and having said gas inlet opening positioned in said lower side wall, and wherein said diffuser pipe overlies said gas supply pipe.

7. An apparatus for introducing gas in the form of fine bubbles into a liquid and which is useful for the aeration of waste water or the like, and comprising:

a gas supply pipe having a gas outlet opening extending therethrough, an elongate integral one-piece gas diffuser pipe having a medial portion and opposite end portions integral with said medial portion, and having a gas inlet opening extending through said medial portion and at least one distribution opening through each of said opposite end portions, said diffuser pipe having plug means disposed in each of said end portions so as to define a closed gas chamber between said plug means and an open ended flooding chamber in each of said opposite end portions, and with said gas distribution openings communicating with said closed gas chamber, means releasably mounting said medial portion of said gas diffuser pipe to and transversely across said gas supply pipe and aligning said outlet opening in said gas supply pipe with said inlet opening in said gas diffuser pipe for providing gas communication from said gas supply pipe to said medial portion of said gas diffuser pipe, and an elastomeric diffuser sleeve disposed coaxially over each of said end portions of said diffuser pipe and so as to overlie the associated gas distribution opening, with each of said sleeves having a multiplicity of perforations therein, whereby gas from said gas supply is caused to enter into said closed gas chamber and then pass through said distribution openings and said perforations of said diffuser sleeves to form fine bubbles in the liquid being treated, and so that the liquid being treated enters said open ended flooding chambers to reduce the buoyance of the apparatus.

8. An apparatus as claimed in Claim 7, further comprising a centering pipe positioned in said gas inlet opening and extending into said gas outlet opening, and seal means surrounding said centering pipe and positioned between said gas supply pipe and said gas diffuser pipe for preventing the escape of gas therefrom.

9. An apparatus as defined in Claim 7, wherein said gas supply pipe comprises a horizontally extending gas supply pipe having an upper side wall and having said gas outlet opening positioned in said upper side wall, wherein said diffuser pipe comprises a horizontally extending diffuser pipe having a lower side wall and having said gas inlet opening positioned in said lower side wall, and wherein said diffuser pipe overlies said gas supply pipe.

10. An apparatus as claimed in Claim 7, wherein each of said diffuser pipe end portions terminates at an outer open end, wherein each of said diffuser sleeves has a medial sleeve end positioned adjacent said diffuser pipe medial portion and an outer sleeve end positioned adjacent said diffuser pipe outer end, and wherein each of said plug means is positioned medially of said outer diffuser sleeve end.

11. An apparatus as claimed in Claim 10, wherein said minute perforations in said diffuser sleeve are substantially uniformly distributed along the length of said diffuser sleeve.

12. A diffuser assembly for introducing gas in the form of fine bubbles into a liquid and which is useful in an apparatus for the aeration of waste water or the like, comprising an elongate integral one-piece gas diffuser pipe having a medial portion, and opposite end portions integral with said medial portion, and having plug means disposed in each of said end portions so as to define a closed gas chamber between said plug means and an open ended flooding chamber in each of said opposite end portions, and at least one gas distribution opening extending through each of said opposite end portions and within said closed gas chamber, said diffuser pipe medial portion having a gas inlet opening extending therethrough, and an elastomeric diffuser sleeve disposed coaxially over each of said end portions of said diffuser pipe and so as to overlie the associated gas distribution opening, with each of said sleeves having a multiplicity of perforations therein, whereby gas is adapted to enter into said closed gas chamber through said gas inlet opening and then pass through said distribution openings and said perforations of said diffuser sleeves to form fine bubbles in the liquid being treated, and so that the liquid being treated enters said open ended flooding chambers to reduce the buoyancy of the diffuser assembly.

13. A diffuser assembly as claimed in Claim 12, wherein each of said diffuser pipe end portions terminates at an outer open end, wherein each of said diffuser sleeves has a medial sleeve end positioned adjacent said diffuser pipe medial portion and an outer sleeve end positioned adjacent said diffuser pipe outer end, and wherein each of said plug means is positioned medially of said outer sleeve end.

14. A diffuser assembly as claimed in Claim 13, wherein said perforations in said diffuser sleeve are substantially uniformly distributed along the length of said diffuser sleeve.

15. A diffuser assembly for introducing gas in the form of fine bubbles into a liquid and which is useful in an apparatus for the aeration of waste water or the like, comprising an elongate gas diffuser pipe defining a medial portion, and opposite end portions, and having plug means disposed in each of said end portions so as to define a closed gas chamber between said plug means and an open ended flooding chamber in each of said opposite end portions, and at least one gas distribution opening extending through each of said opposite end portions and within said closed gas chamber, said diffuser pipe medial portion having a gas inlet opening extending therethrough, and an elastomeric diffuser sleeve disposed coaxially over each of said end portions of said diffuser pipe and so as to overlie the associated gas distribution opening, with each of said sleeves having a multiplicity of perforations therein, and wherein said diffuser pipe is formed of plastic and wherein each of said plug means comprises a cup-shaped plastic insert sealably connected to the interior wall of said diffuser pipe, whereby gas is adapted to enter into said closed gas chamber through said gas inlet opening and then pass through said distribution openings and said perforations of said diffuser sleeves to form fine bubbles in the liquid being treated, and so that the liquid being treated enters said open ended flooding chambers to reduce the buoyancy of the diffuser assembly.

16. A diffuser assembly as claimed in Claim 15, wherein each of said inserts has a convex, resilient inner surface.

17. An apparatus for introducing gas in the form of fine bubbles into a liquid and which is useful for the aeration of waste water or the like, and comprising a gas supply pipe, an elongate gas diffuser pipe defining a medial portion, and opposite end portions, and having plug means disposed in each of said end portions so as to define a closed gas chamber between said plug means and an open ended flooding chamber in each of said opposite end portions, and at least one gas distribution opening extending through each of said opposite end portions and within said closed gas chamber, wherein said diffuser pipe is formed of plastic and wherein each of said plug means comprises a cup-shaped plastic insert sealably connected to the interior wall of said diffuser pipe, means mounting said medial portion of said gas diffuser pipe to said gas supply pipe so as to provide gas communication between said gas supply pipe and said closed gas chamber of said gas diffuser pipe, and an elastomeric diffuser sleeve disposed coaxially over each of said end portions of said diffuser pipe and so as to overlie the associated gas distribution opening, with each of said sleeves having a multiplicity of perforations therein, whereby gas from said gas supply pipe is adapted to enter into said closed gas chamber and then pass through said distribution openings and said perforations of said diffuser sleeves to form fine bubbles in the liquid being treated, and so that the liquid being treated enters said open ended flooding chambers to reduce the buoyancy of the apparatus.

18. An apparatus for introducing gas in the form of fine bubbles into a liquid and which is useful for the aeration of waste water or the like, and comprising a gas supply pipe having a gas outlet opening extending therethrough, an elongate gas diffuser pipe defining a medial portion and opposite end portions, and having a gas inlet opening extending through said medial portion and at least one distribution opening extending through each of said opposite end portions, means releasably mounting said medial portion of said gas diffuser pipe to and transversely across said gas supply pipe and aligning said outlet opening in said gas supply pipe with said inlet opening in said gas diffuser pipe for providing gas communication from gas supply pipe to said medial portion of said gas diffuser pipe, and an elastomeric diffuser sleeve disposed coaxially over each of said opposite end portions of said diffuser pipe, with each of said sleeves having a multiplicity of perforations therein, wherein said means releasably mounting said medial portion of said gas diffuser pipe to and transversely across said gas supply pipe comprises support means connected to said supply pipe on each side of said gas inlet opening for supporting said diffuser pipe on said supply pipe, and clamp means carried by each of said support means for clamping said diffuser pipe to said supply pipe;

whereby the gas from said gas supply pipe is caused to enter into said medial portion of said gas diffuser pipe and then pass through said distribution openings and said perforations of said diffuser sleeves to form fine bubbles in the liquid being treated.

19. An apparatus for introducing gas in the form of fine bubbles into a liquid and which is useful for the aeration of waste water or the like, and comprising a gas supply pipe having a gas outlet opening extending therethrough, an elongate gas diffuser pipe defining a medial portion and opposite end portions, and having a gas inlet opening extending through said medial portion and at least one distribution opening extending through each of said opposite end portions, said diffuser pipe having plug means disposed in each of said end portions so as to define a closed gas chamber between said plug means and an open ended flooding chamber in each of said opposite end portions, and with said gas distribution openings communicating with said closed gas chamber, means releasably mounting said medial portion of said gas diffuser pipe to and transversely across said gas supply pipe and aligning said outlet opening in said gas supply pipe with said inlet opening in said gas diffuser pipe for providing gas communication from said gas supply pipe to said medial portion of said gas diffuser pipe, an elastomeric diffuser sleeve disposed coaxially over each of said end portions of said diffuser pipe and so as to overlie the associated gas distribution opening, with each of said sleeves having a multiplicity of perforations therein, and wherein said diffuser pipe is formed of plastic and wherein each of said plug means comprises a cup-shaped plastic insert sealably connected to the interior wall of said diffuser pipe;

whereby gas from said gas supply pipe is caused to enter into said closed gas chamber and then pass through said distribution openings and said perforations of said diffuser sleeves to form fine bubbles in the liquid being treated, and so that the liquid being treated enters said open ended flooding chambers to reduce the buoyancy of the apparatus.

20. An apparatus for introducing gas in the form of fine bubbles into a liquid and which is useful for the aeration of waste water or the like, and comprising a gas supply pipe having a gas outlet opening extending therethrough, an elongate gas diffuser pipe defining a medial portion and opposite end portions, and having a gas inlet opening extending through said medial portion and at least one distribution opening extending through each of said opposite end portions, said diffuser pipe having plug means disposed in each of said end portions so as to define a closed gas chamber between said plug means and an open ended flooding chamber in each of said opposite end portions, and with said gas distribution openings communicating with said closed gas chamber, means releasably mounting said medial portion of said gas diffuser pipe to and transversely across said gas supply pipe and aligning said outlet opening in said gas supply pipe with said inlet opening in said gas diffuser pipe for providing gas communication from said gas supply pipe to said medial portion of said gas diffuser pipe, and an elastomeric diffuser sleeve disposed coaxially over each of said end portions of said diffuser pipe and so as to overlie the associated gas distribution opening, with each of said sleeves having a multiplicity of perforations therein, and wherein said means releasably mounting said medial portion of said gas diffuser pipe to and transversely across said gas supply pipe comprises support means connected to said supply pipe on each side of said gas inlet opening for supporting said diffuser pipe on said supply pipe, and clamp means carried by each of said support means for clamping said diffuser pipe to said supply pipe, whereby gas from said gas supply pipe is caused to enter into said closed gas chamber and then pass through said distribution openings and said perforations of said diffuser sleeves to form fine bubbles in the liquid being treated, and so that the liquid being treated enters said open ended flooding chambers to reduce the buoyancy of the apparatus.

* * * * *